United States Patent [19]

Pasquarella

[11] Patent Number: 4,884,160

[45] Date of Patent: Nov. 28, 1989

[54] CONSTANT CURRENT ACTUATOR FOR INDUCTIVE LOAD

[75] Inventor: Stephen T. Pasquarella, Rochester, N.Y.

[73] Assignee: VA Inc., Rochester, N.Y.

[21] Appl. No.: 320,885

[22] Filed: Mar. 10, 1989

Related U.S. Application Data

[63] Continuation of Ser. No. 129,162, Dec. 7, 1987, abandoned.

[51] Int. Cl.[4] ..... H01H 47/32

[52] U.S. Cl. ..... 361/18; 361/154; 307/64; 307/66; 323/268

[58] Field of Search ..... 361/18, 58, 152–155, 361/196, 91; 307/54, 55, 58, 59, 64, 63, 75, 80, 81, 86, 66; 323/268; 318/442, 430

[56] References Cited

U.S. PATENT DOCUMENTS

| | | | |
|---|---|---|---|
| 4,035,716 | 7/1977 | Hutchinson | 307/64 X |
| 4,326,234 | 4/1982 | Shuey | 361/154 |
| 4,456,833 | 6/1984 | Traub et al. | 323/268 X |
| 4,697,221 | 9/1987 | Pasquarella | 361/156 |
| 4,729,156 | 3/1988 | Edwards et al. | 361/154 |

OTHER PUBLICATIONS

Power Linear Actuators, 1st Edition, 3/1983, pp. 253–264.

*Primary Examiner*—Todd E. Deboer
*Attorney, Agent, or Firm*—Hoffman Stone

[57] ABSTRACT

An actuator circuit for an inductive load includes a first low impedence source of direct current at a relatively high voltage, a second low impedance source at a lower voltage, a switching arrangement responsive to an input signal for connecting a load across the first source at the beginning of the signal and for a predetermined initiating interval thereafter, and at the end of the interval switching the load from the first to the second source, and a feedback control for limiting the current through the load to a first, constant value during the initiating interval and to second, lower constant value thereafter. The circuit cuts off the load when the input signal ceases or it removed.

2 Claims, 3 Drawing Sheets

CONSTANT CURRENT ACTUATOR FOR INDUCTIVE LOAD

This is a continuation of application Ser. No. 129,162, filed 12/7/87, now abandoned.

This invention relates to a novel actuator for an inductive load. It was devised primarily for operating an electromagnetically driven photographic shutter of the kind described in U.S. Pat. No. 3,664,251, but is expected to find broader application, especially in situations where the driven load may not be rugged and able to withstand repeated shocks. It arose as a result of efforts to extend the operating life of the patented shutters.

Previsously shutters of the patented type had, typically, a life of about one million operations before failure, which usually was of a mechanical nature. Suprisingly, when driven by the circuit of the present invention the shutter's life has been found to exceed twenty million operations.

BRIEF DESCRIPTION

The circuit is derived partly from, and includes certain of the underlying principles embodied in the actuator described in U.S. Pat. No. 4,697,221. It provides an initiating voltage of a first magnitude for starting actuation of the load, and a subsequent, holding voltage of smaller value for completing actuation of the load and holding it in its actuated position. In both cases current is drawn from a source of very low impedance, and the magnitude of the current is controlled by a negative feedback arrangement. For lack of a more apt terminology the circuit has been designated a constant current actuator.

Previous actuators for the shutter generally provided for intiating actuation by discharging a capacitor that had been charged to a relatively high voltage, typically about 36 to about 60 volts, through the shutter coil, and then following on with a sustaining voltage to hold the shutter actuated for the desired period. The arrangement enabled relatively rapid actuation of the shutter and was highly reliable. The life of shutters of this type having an aperture of ¼" was generally just over one million operations, entirely satisfactory in a large number of applications. A request was received, however, for a shutter of this kind having a service life of over twenty million operations. The present invention arose in response to that request.

According to the invention it has now been found that this dramatic increase in service life may be achieved without significantly impairing performance by substantially reducing the magnitude of the initiating voltage, applying it from a current source of very low internal impedance, and dynamically limiting the current flow through the coil. The speed of response of the shutter is, concededly, reduced, but to a surprisingly small degree, while the service life is extended by a factor of about twenty.

During the initiating interval the current through the shutter is limited to a first, predetermined value, and thereafter, during the sustaining period, the current is limited to a substantially lower, sustaining value. Alternatively, according to one embodiment of the invention, the sustaining current may consist of time-spaced pusles of current similarly to the pulsed arrangement described in U.S. Pat. No. 4,697,221. Preferably, however, and in accordance with the presently preferred embodiment, the sustaining current is continuous, but is drawn form a source having a voltage substantially lower than the voltage of the source from which the initiating current is drawn. In all cases, however, the initiating current is taken from a source at a voltage somewhat lower than the voltage to which the initiating capacitors of the previous actuators had been charged, and having a relatively low internal impedance so that its output voltage remains substantially constant.

DETAILED DESCRIPTION

Representative embodiments of the invention will now be described in detail in conjunction with the accompanying drawings, wherein.

Although the circuit of the invention is expected to be found useful for driving various different types of inductive devices it arose in connection with photographic shutters of the above-mentioned kind, and will be described in that connection in the following description.

Figure 1:
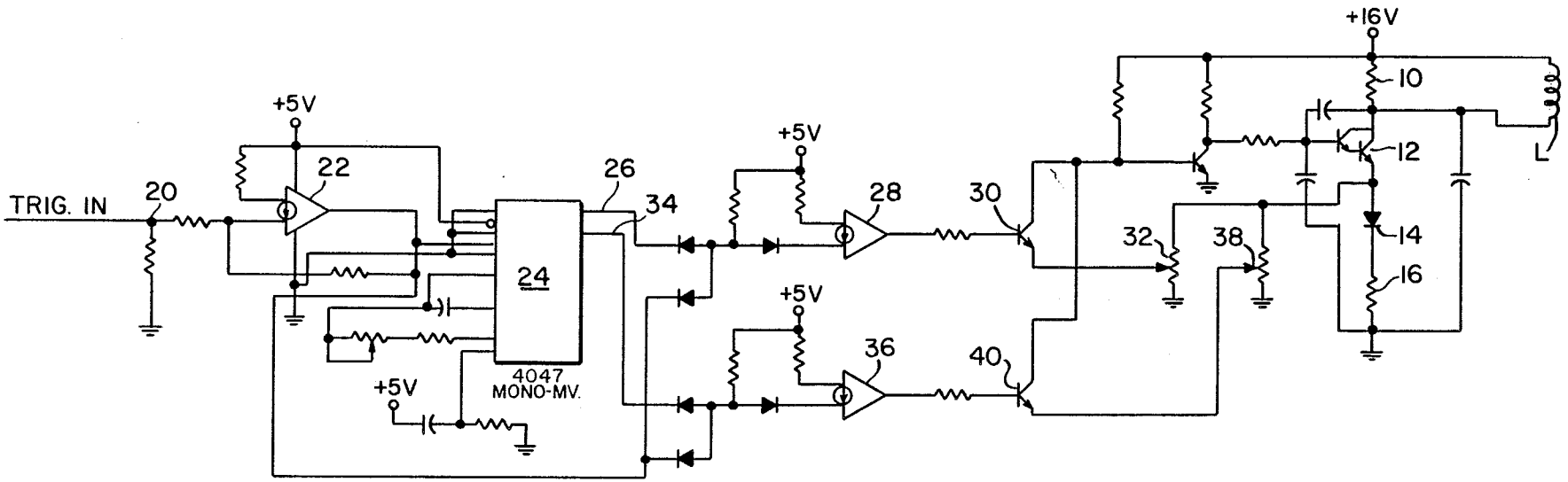
FIG. 1 is a schematic diagram of an actuator according to a first embodiment of the invention.

Referring first to FIG. 1, the load L is connected in shunt with the collector resistor 10 of the output drive amplifier 12, which is normally in its OFF condition, and which is turned ON during actuation of the load and controls the amplitude of the current flowing through the load. The emitter of the output amplifier 12 is grounded through a diode 14 and a feedback resistor 16 of relatively low value such as, for example, one ohm.

Operation of the circuit starts with the application of a trigger voltage at the input terminal 20. The trigger voltage continues for the desired duration of shutter actuation, typically the exposure time desired for taking a photograph. The trigger voltage is fed through an amplifier 22 to trip a monostable multivibrator 24, whereupon the first output 26 of the multivibrator goes HIGH to switch ON the first control amplifier 28. The output of the control amplifier 28 is fed through a feedback transistor 30 to turn ON the output amplifier 12.

The value of the current through the output amplifier 12 is regulated by the feedback transistor 30 through the feedback circuit portion which includes the feedback resistor 16, and, in this case, the variable voltage divider 32, the tap of which is connected to the emitter of the feedback transistor 30.

Thus, for the duration of the timing period of the multivibrator 24, the full collector voltage is available for energizing the load L, and the instantaneous value of current through the load is limited by the negative feedback arrangement.

Following timeout of the multivibrator 24, assuming the trigger voltage continues at the input terminal 20, the first output 26 reverts to its normal, LOW, condition, and the second output terminal 34 goes HIGH and remains HIGH until the trigger voltage is removed. When the first output terminal goes LOW the first control, or initiating amplifier 28 is turned OFF, and when, simultaneously, the second output terminal goes HIGH a second, sustaining amplifier 36 is turned ON, keeping the output amplifier 12 ON, but regulating the current through it and the load L at a second, much lower value determined by the second, sustaining feedback circuit comprised of the feedback resistor 16, and a second variable voltage divider 38, the tap of which is connected to the emitter of the second control transistor 40 for regulating the output of the sustaining control amplifier 36.

At the end of the desired exposure time as determined by the duration of the input trigger voltage, both outputs 26 and 34 of the multivibrator 24 go LOW, and the output amplifier 12 is turned OFF.

The collector resistor 10 of the output amplifier shunts the load L and effectively prevents the buildup of excessive induced voltage across the load immediately following turn-off.

It is not known exactly why the present circuit enables extension of the shutter life from its previous one million to its present twenty million operations without unacceptable loss of response speed. It is believed, however, that the lower initiating voltage, now typically sixteen to twenty four volts, imposes less stress on the shutter mechanism than did the previously used thirty six to sixty volts, particularly at the end of its opening travel. And the response speed is maintained due to the constant value of the source voltage, which contrasts with the continual decay of the voltage across the initiating capacitor in the circuits of the prior art.

Figure 2:
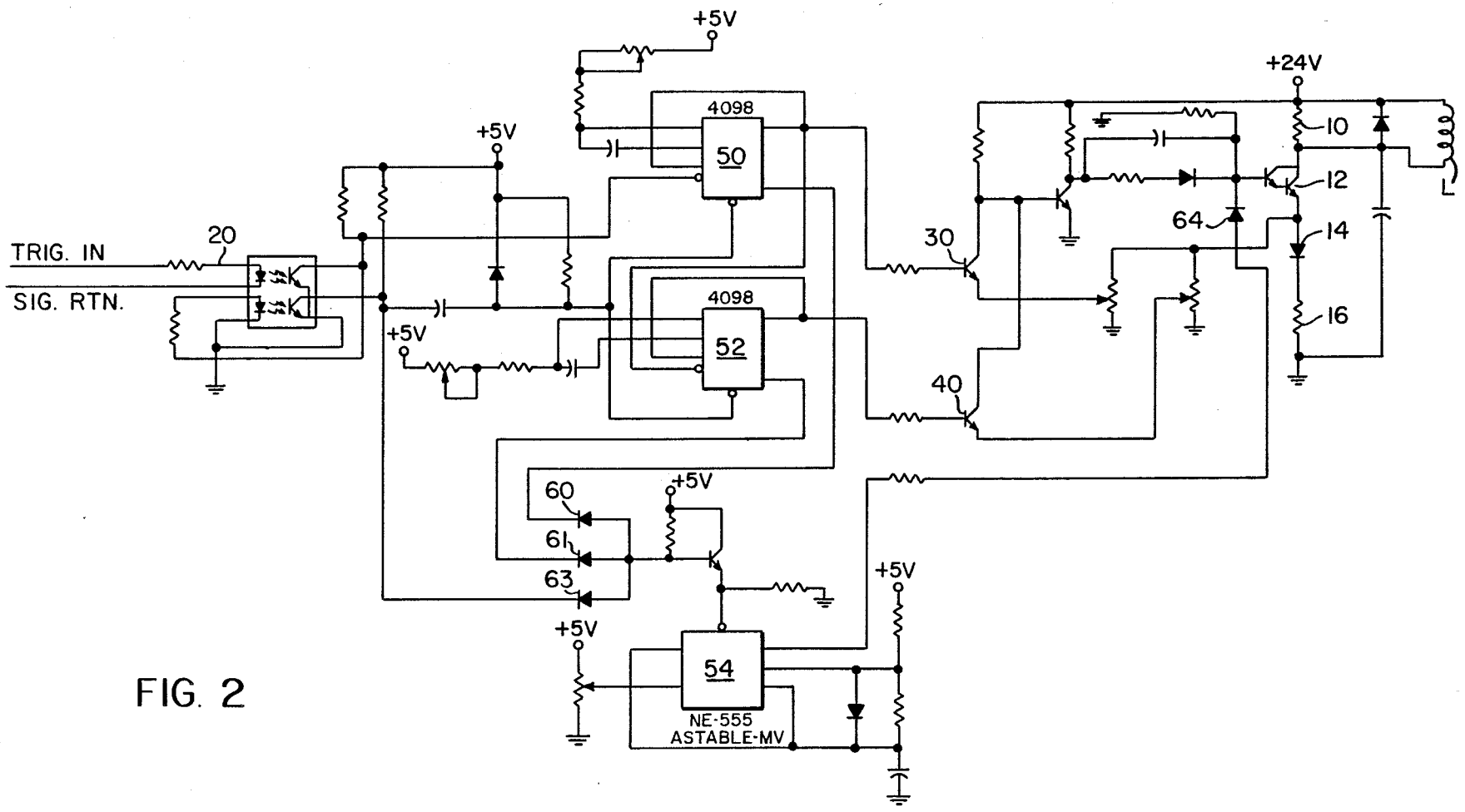
FIG. 2 is a schematic diagram of an actuator according to a second embodiment of the invention.

A second embodiment of the invention is shown in FIG. 2. This was developed in response to a desire to reduce the heat dissipation in the output amplifier 12 during prolonged actuating periods such as, for example, when the shutter is held open for several minutes during a focussing operation. Operation of thus second embodiment is generally similar to operation of the embodiment of FIG. 1 except, principally, that the sustaining current following the initiating period consists of a series of time-spaced pulses instead if being continuous.

The second embodiment includes two monostable multivibrators 50 and 52 and a 555 timer 54. The multivibrators are connected in cascade turning ON the output amplifier 12 thorugh the first, initiating feedback transistor 30 during the initiating period, and then through the second feedback transistor 40 during the sustaining period. The NOT outputs of the multivibrators 50 and 52 are connected through the gate consisting of the three diodes 60, 61 and 62 to turn ON the 555 timer during the sustaining period.

(The diodes 60, 61 and 62 constitute a conventional OR gate, sensing the presence of a LOW condition at the cathode of any one of the three diodes to keep the 555 timer turned OFF. The AND function, however, is the primary thought in connection with this gate because the design seeks to determine the simultaneous presence of the HIGH condition at all three cathodes to allow the timer to be turned ON.)

The output of the 55 timer is applied through a diode 64 to pulse the output amplifier alternately ON and OFF during the sustaining period, thereby reducing the average value of current through the load L during the sustaining period without causing the output amplifier 12 to dissipate excessive heat. The output amplifier is not used to control the magnitude of the current during the sustaining period, but is alternately fully ON and fully OFF.

The circuit of the second embodiment effectively cured the heating problem previously found in the output amplifier 12 in the first embodiment during long exposure times, but unfortunately it was found that the shutter coil heated more than desired, and this was so even when the duration of the energizing current pulses was reduced to the minimum value needed for holding the shutter actuated. It is believed that this occurred because of the E 2/R effect whereby the heating of the coil at the relatively high input voltage outweighed the time averaging effect.

Figure 3:
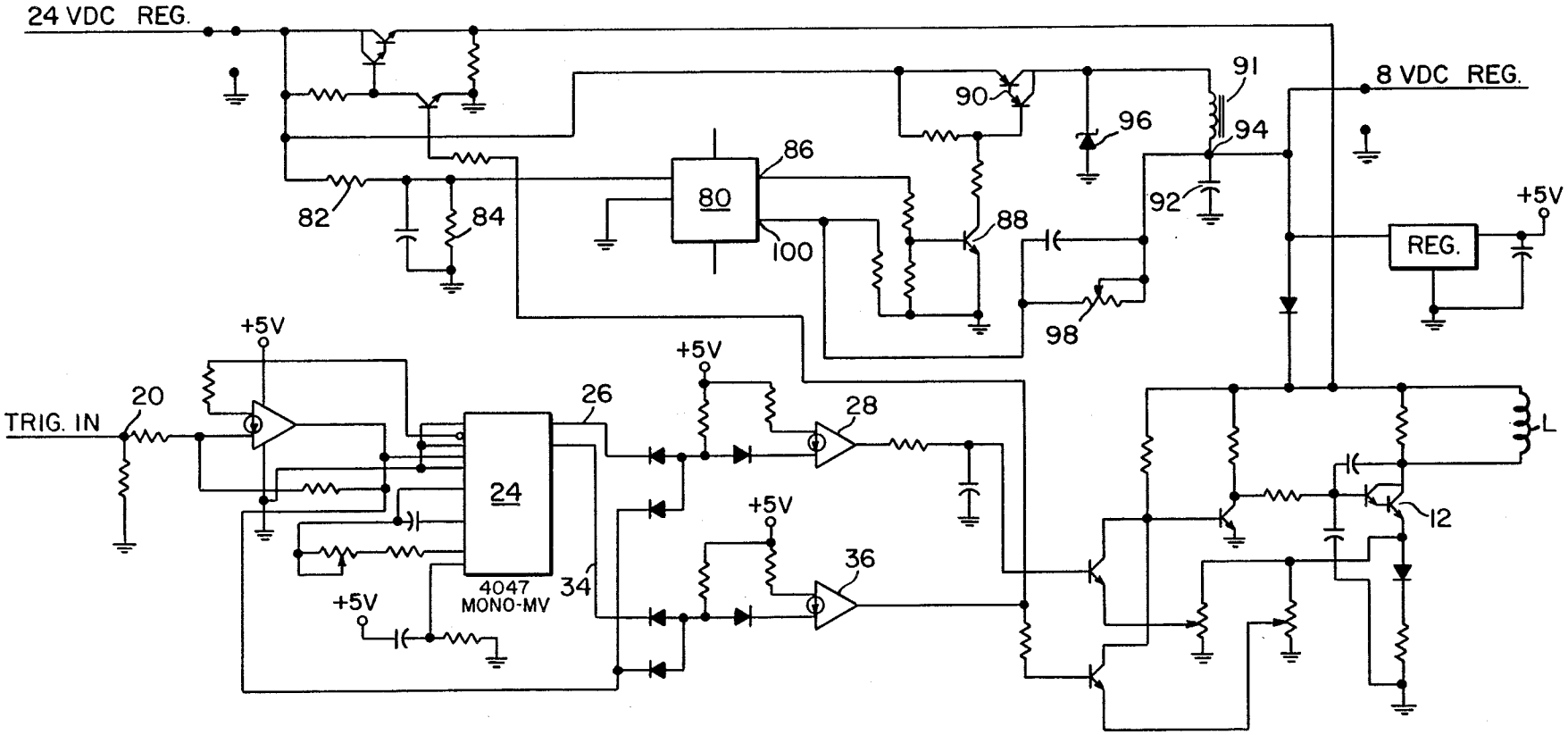
FIG. 3 is a schematic diagram of an actuator according to a third, and presently preferred, embodiment of the invention.

The circuit shown in FIG. 3, the third embodiment, effectively resolved all known problems, and without resorting to the pulsed energization used during the sustaining period in the second embodiment. In this circuit the initiating current is applied to the load L from a low impedance source having a voltage of about 24 volts, and the sustaining current is drawn from a source having a voltage of about 8 volts. A step-down switching regulator 80 is used to derive the 8 volt source from the 24 volt source, thus saving the cost of a separate power supply. Any desired step-down regulator may, of course be used, or any other desired source at a voltage of about eight volts. The least expensive regulator known at present capable of giving satisfactory service is one commercially known as MAX638, sold by Maxim Integrated Products, Sunnyvale, Calif., and for reasons of cost that is presently the preferred regulator.

The regulator 80 in the present case is connected to the 24 volt current source through a voltage divider network consisting of two resistors 82 and 84 because of internal limitations in the regulator. Its output terminal 86 is connected to the base of a regulating transistor 88, the collector of which is connected to bias a PNP Darlington amplifier 90. The Darlington amplifier 90 is connected in series between the 24 volt source on one side and, on the other side, a ballast inductor 90, a capacitor 92, and ground. The common terminal 94 of the inductor 91 and the capacitor 92 is the output terminal of the 8 volt spource. A Schottky diode 96 shunts the inductor 90 and capacitor 92.

The actual value of the output voltage of the regulator may be adjusted by varying the variable resistor 98 connected between the output terminal 94 and the bias terminal 100 of the regulator.

The operation of the circuit is generally similar to the operation of the first two embodiments. The output amplifier 12 is driven from the 24 volt source during the initiating period, and then from the 8 volt source during the sustaining period.

It will be understood that the exact circuit arrangements shown and described herein are not essential to the practice of the invention. Many different specific circuits can be devised to function according to the invention, and those shown here are only illustrative.

What is claimed is:

1. A circuit for energizing an inductive load comprising: a first source of direct current having a low internal impedance and a first voltage, a second source of direct current having a low internal impedance and a second voltage lower than said first voltage, switching means for selectively connecting a load across said sources, timed control means responsive to an input signal for controlling said switch means so that switch means connects the load continuously across said first source for a predetermined initiating interval immediately following the beginning of the input signal and continuously across said second source immediately following the initiating interval until the end of the input signal, and current control means including a feedback loop for limiting the maximum current through the load to a first predetermined constant value during the initiating interval and to a second, lower, constant value thereafter until the end of the input signal.

2. Method of actuating an inductive load in response to an input signal of definite but unforeknown duration, said method comprising the steps of first, at the beginning of the input signal, connecting the load to a first low impedance source of direct current at a first voltage and keeping the load so connected continuously for a predetermined initiating interval, second, at the end of the initiating interval, switching the load to a second low impedance source of direct current at a voltage lower than said first voltage and keeping the load continuously so connected for the balance of the duration of the input signal, and limiting the maximum amount of current that flows through the load to a first constant value during the initiating interval and to a second, lower, constant value during the balance of the duration of the input signal.

* * * * *